United States Patent [19]

Ogihara

[11] 4,425,685

[45] Jan. 17, 1984

[54] SEPARABLE SLIDE FASTENER

[75] Inventor: Toru Ogihara, Funabashi, Japan

[73] Assignee: Yoshida Kogyo K. K., Tokyo, Japan

[21] Appl. No.: 311,431

[22] Filed: Oct. 14, 1981

[30] Foreign Application Priority Data

Oct. 15, 1980 [JP] Japan ..... 55-146595[U]

[51] Int. Cl.[3] ..... A44B 19/24

[52] U.S. Cl. ..... 24/434

[58] Field of Search ..... 24/205.11 R, 205.11 L, 24/205.11 F, 205.16 R, 205.16 C, 205.13 C; 66/193

[56] References Cited

U.S. PATENT DOCUMENTS

| | | | |
|---|---|---|---|
| 3,507,013 | 4/1970 | Inazawa | 24/205.16 C |
| 3,919,744 | 11/1975 | Kandou | 24/205.16 C |
| 3,962,756 | 6/1976 | Ebata | 24/205.16 C |
| 4,182,007 | 1/1980 | Yoshida et al. | 24/205.16 C |
| 4,319,387 | 3/1982 | Yoshida | 24/205.16 C |

FOREIGN PATENT DOCUMENTS

| | | | |
|---|---|---|---|
| 51-135709 | of 1976 | Japan | 24/205.16 R |
| 52-24161 | of 1977 | Japan | 24/205.16 R |

*Primary Examiner*—Paul J. Hirsch

*Attorney, Agent, or Firm*—Hill, Van Santen, Steadman & Simpson

[57] ABSTRACT

A separable slide fastener comprises a pair of warp-knit stringer tapes each having a pair of webs with a wale-free region therebetween, which are interconnected by a connector thread extending across the wale-free region at longitudinal intervals, the wale-free region being receptive of a chain of thread loops for attaching the stringer tape to a fabric. A pair of rows of coupling elements is mounted on opposite longitudinal edges of the stringer tapes and taken into and out of interdigitating engagement by a slider movable along the rows of coupling elements. The stringer tapes have at one end thereof a separable bottom end stop. A reinforcement member is mounted on each of the stringer tapes at the one end thereof and connected to the separable bottom end stop. The reinforcement member extends between the tape webs across the wale-free region and includes a roughened surface such as teeth adjacent to the wale-free region for engagement with an end of the chain of thread loops on the reinforcement member against displacement thereof.

5 Claims, 7 Drawing Figures

SEPARABLE SLIDE FASTENER

BACKGROUND OF THE INVENTION

1. Field of the Invention

The present invention relates to a separable slide fastener for use on knit garments such as cardigan sweaters.

2. Prior Art

There have been proposed separable slide fasteners which have in their stringer tapes longitudinal coarse regions or openings loosely receptive of a chain of thread loops for attaching the stringer tape to a knit garment, and which include a separable bottom end stop mounted on a lower end of the stringer tapes. Such separable slide fasteners are described in copending U.S. patent applications Ser. Nos. 223,201 and 258,647 filed Jan. 7, 1981 and Apr. 29, 1981, respectively, which have been assigned to the present assignee. The proposed separable slide fasteners are connected to knit garments on a knitting machine or linking machine with needles of the machine insertable into the openings in the stringer tape. The separable slide fastener as attached to the knit garment is prevented from becoming puckered or wavy since the openings in the tape that loosely accommodate the thread loops take up forces applied to the knit garment. The knit garment such as a cardigan sweater, while worn with the slide fastener closed, is subjected to a lateral pull particularly at its hem or lower end around the wearer's waist, imposing more tension on a lower end of the slide fastener than on other parts of the latter. Therefore, an end of the chain of thread loops which extends around the separable bottom end stop on the lower end of the slide fastener is likely to be displaced laterally off the separable bottom end stop under continued or sudden lateral stresses.

SUMMARY OF THE INVENTION

A separable slide fastener according to the present invention includes a reinforcement member mounted on each of the stringer tapes at a lower end thereof and connected to a separable bottom end stop attached to the end of the stringer tapes, the reinforcement member extending transversely of the stringer tape across a wale-free coarse region between laterally spaced webs of the stringer tape. The reinforcement member includes a thick body injection-molded around the lower end of the stringer tape and having a bottom facing away from the tape, there being a roughened surface or a series of teeth defined on the bottom of the reinforcement member and coextensive substantially widthwise with the wale-free coarse region. When the separable slide fastener is mounted on a knit fabric by chains of thread loops along the wale-free regions, a lowermost one of the thread loops extends around the body of each reinforcement member and engages the teeth against displacement off the reinforcement body. The thick body of each reinforcement member may have on each of the opposite surfaces thereof a series of teeth extending longitudinally of the stringer tape, or may have on a bottom and opposite surfaces thereof a series of continuous teeth extending around the body in the longitudinal direction of the stringer tape.

It is an object of the present invention to provide a separable slide fastener attachable to a knit garment and having means for anchoring a thread loop stably on a separable bottom end stop on a lower end of the slide fastener against displacement under forces applied to the knit garment to which the slide fastener is attached.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
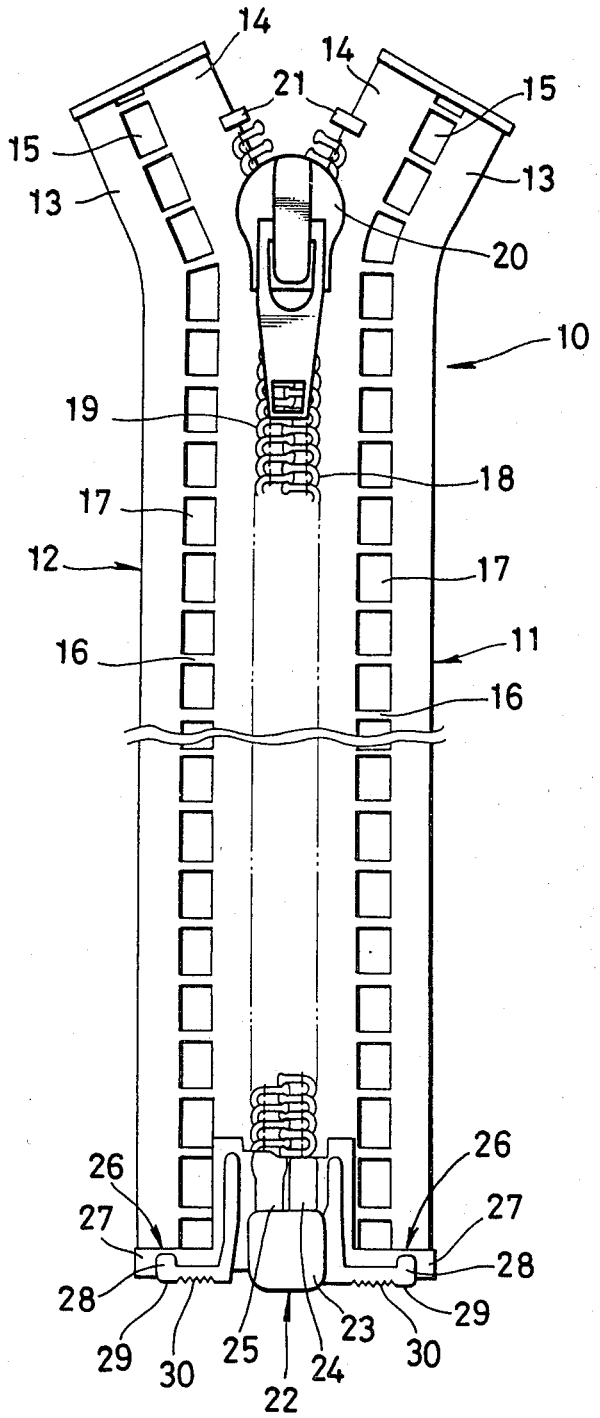
FIG. 1 is a plan view of a separable slide fastener according to the present invention.

FIG. 1 illustrates a separable slide fastener 10, for use on a garment such as a cardigan sweater having completely separable opposite edges along which the fastener is attachable, comprising a pair of warp-knit stringer tapes 11, 12 each including a pair of first and second longitudinal warp-knit webs 13, 14 with a ladder-like wale-free coarse region 15 therebetween which is preferably devoid of one to four wales. The webs 13, 14 are interconnected by a connector thread 16 extending transversely across the wale-free region 15 at longitudinal intervals, providing a plurality of rectangular openings 17 arranged longitudinally in and along the wale-free region 15. A pair of rows of coupling elements 18, 19 which are made preferably of filamentary plastic material is mounted respectively on the second webs 14, 14 along longitudinal opposite edges thereof. A slider 20 is slidably mounted on the rows of coupling elements 18, 19 for taking the latter into and out of interdigitating engagement to open and close the slide fastener 10. A pair of top end stops 21, 21 is secured respectively to the opposed edges of the webs 14, 14 and located at upper ends of the stringer tapes 11, 12 to prevent the slider 20 from running off the rows of coupling elements 18, 19 past the top end stops 21, 21.

Figure 2:
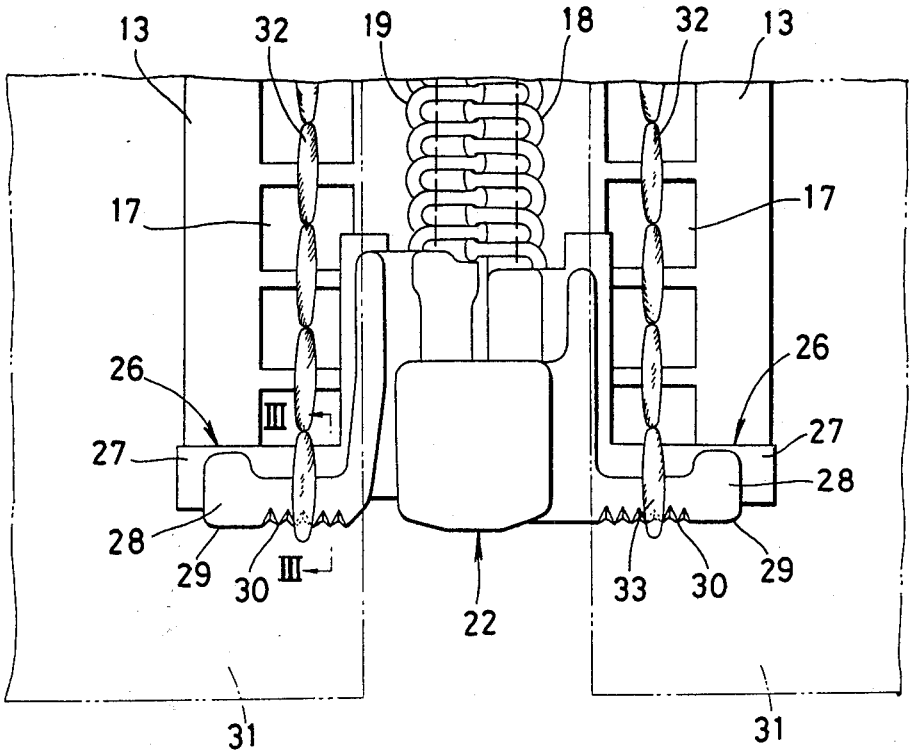
FIG. 2 is an enlarged fragmentary plan view of the separable slide fastener of FIG. 1 as attached to a knit fabric.
Figure 3:
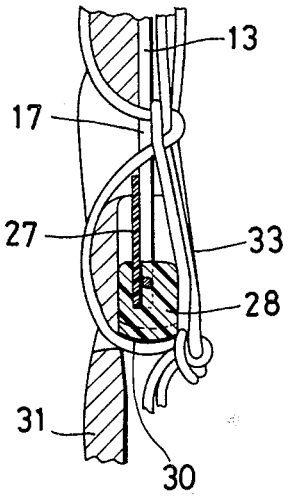
FIG. 3 is an enlarged cross-sectional view taken along line III—III of FIG. 2.

The separable slide fastener 10 also includes a separable bottom end stop 22 at a lower end thereof which comprises a box 23 and box pin 24 mounted on the stringer tape 11 and a pin 25 mounted on the stringer tape 12. Each of the stringer tapes 11, 12 has on its lower end a reinforcement member 26 of thermoplastic synthetic resin connected to the separable bottom end stop 22 and comprising an L-shaped thin film 27 bonded to the stringer tape and a thick body 28 injection-molded around the lower end of the stringer tape. The reinforcement member 26 extends transversely across the wale-free region 15. As shown in FIGS. 1 and 2, the body 28 of each reinforcement member 26 has a bottom 29 facing away from the stringer tape and a roughened surface comprising a series of teeth 30 defined on the bottom 29 and coextensive substantially widthwise with the wale-free region 15, the teeth 30 projecting longitudinally of the stringer tape 11, 12. When the separable slide fastener 10 is mounted on a knit fabric 31 by chains of thread loops 32 along the wale-free regions 15, a lowermost one 33 of the thread loops 32 extends around the body 28 of each reinforcement member and engages the teeth 30 against displacement laterally off the reinforcement body 28 under forces applied to the knit fabric 31 which tend to pull apart the slide fastener 10.

Figure 4:
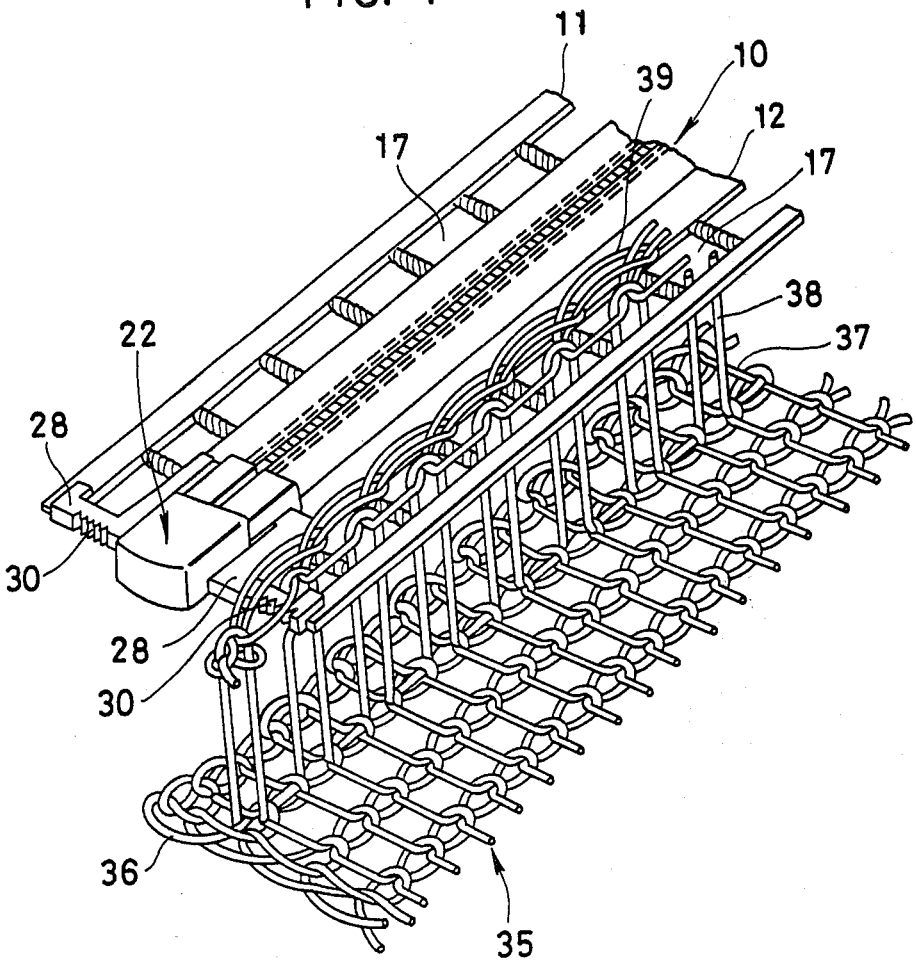
FIG. 4 is an enlarged fragmentary perspective view of the separable slide fastener shown in FIG. 1 as attached to a knit fabric with thread loops.

The separable slide fastener 10 can be attached to a knit fabric 35 along an edge 36 thereof on a knitting or linking machine in a manner as illustrated in FIG. 4. The knitting or linking machine has knitting needles or points (not shown) inserted through the knit fabric 35 along a course 37 and the openings 17 in one of the stringer tapes. Upon operation of the machine, needle loops 38 are looped around the needles and then interlooped with a chain of thread loops 39, thus forming a double chain stitch which connects the slide fastener 10 to the knit fabric 35.

Figure 5:
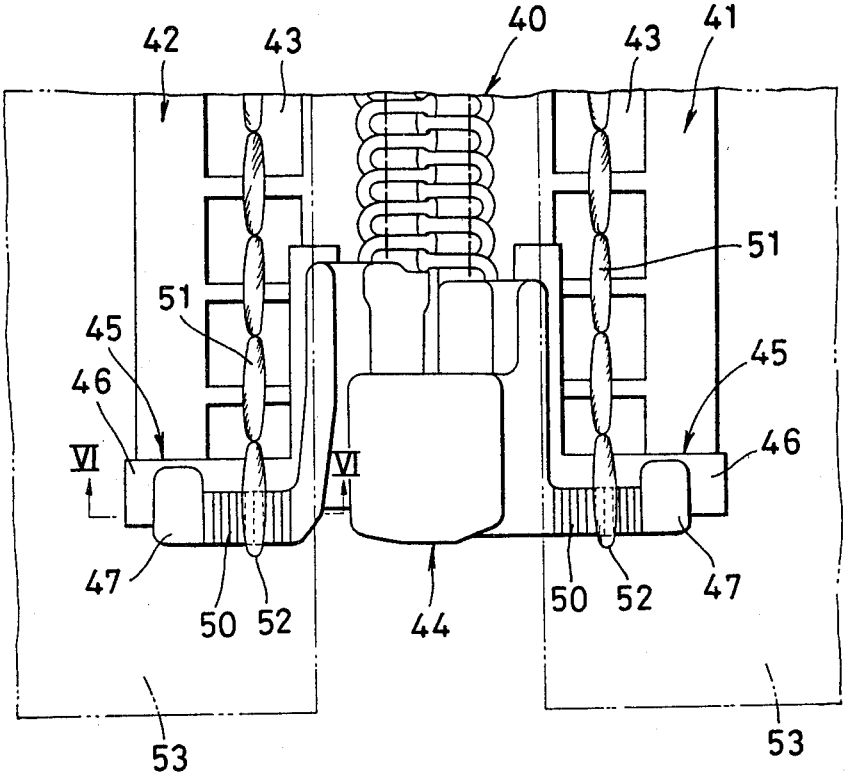
FIG. 5 is a fragmentary plan view of a separable slide fastener according to another embodiment.
Figure 6:
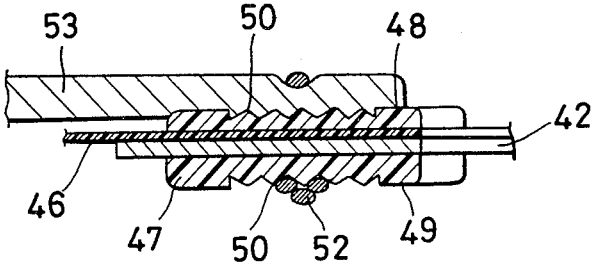
FIG. 6 is an enlarged cross-sectional view taken along line VI—VI of FIG. 5.

FIGS. 5 and 6 illustrate a separable slide fastener 40 according to another embodiment comprising a pair of warp-knit stringer tapes 41, 42 each including a wale-free region 43 and a separable bottom end stop 44 mounted on the stringer tapes 41, 42 at lower ends thereof. Each of the stringer tapes 41, 42 has on the lower end a reinforcement member 45 comprising a thin film 46 extending transversely across the wale-free region 43 and a thick body 47 disposed around the lower end of the stringer tape. The thick body 47 has a pair of opposite surfaces 48, 49 (FIG. 6), one on each side of the stringer tape 41, 42, each of the surfaces 48, 49 having defined thereon a series of teeth 50 extending longitudinally of the stringer tape 41, 42. With the slide fastener 40 attached to a knit fabric 53 by thread loops 51, a lowermost thread loop 52 engages the teeth 50 on each reinforcement body 47 and is prevented thereby from being displaced laterally on the body 47.

Figure 7:
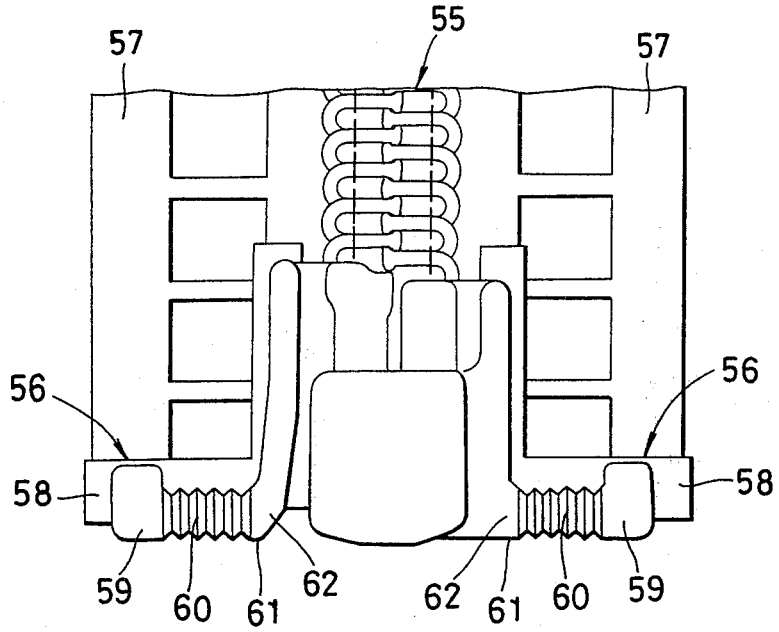
FIG. 7 is a fragmentary plan view of a separable slide fastener according to still another embodiment.

Another separable slide fastener 55 shown in FIG. 7 comprises a reinforcement member 56 mounted on a lower end of each warp-knit stringer tape 57 and comprising a thin film 58 extending transversely of the stringer tape 57 and a thick body 59 disposed around the lower end of the stringer tape 57. The body 59 has a series of continuous teeth 60 on each of its bottom 61 and opposite surfaces 62 (one shown), the teeth 60 extending longitudinally of the stringer tape 57. The teeth 60 thus defined continuously around the body 59 enables a thread loop (not shown) to be more stably anchored on the body 59 against displacement.

Although various minor modifications might be suggested by those in the art, it should be understood that I wish to embody within the scope of the patent warranted hereon, all such embodiments as reasonably and properly come within the scope of my contribution to the art.

I claim as my invention:

1. A separable slide fastener comprising:

(a) a pair of warp-knit stringer tapes each including a pair of first and second webs with a wale-free region extending longitudinally therebetween, and a connector thread interconnecting said first and second webs transversely across said wale-free region at longitudinal intervals, said stringer tapes being juxtaposed with said second webs disposed adjacent to each other, said wale-free region being receptive of a chain of thread loops for connecting said stringer tape to a fabric;

(b) a pair of rows of coupling elements each mounted on said second web of one of said stringer tapes remotely from said wale-free region;

(c) a slider movable along said pair of rows of coupling elements for engaging and disengaging the latter;

(d) a separable bottom end stop comprising a box and a box pin extending therefrom, which are mounted on one of said stringer tapes at one end thereof, and a pin mounted on the other stringer tape at one end thereof and insertable into said box; and (e) a reinforcement member mounted on each of said stringer tapes at said one end thereof and connected to said separable bottom end stop and extending between said first and second webs across said wale-free region, said reinforcement member including a roughened surface coextensive substantially widthwise with said wale-free region for engagement with an end of the chain of thread loops of said reinforcement member against displacement thereof.

2. A separable slide fastener according to claim 1, said reinforcement member including a body disposed around said one end of the stringer tape and extending transversely of said stringer tape, said roughened surface comprising a series of teeth defined on said body and having an extent longitudinally of said stringer tape.

3. A separable slide fastener according to claim 2, said body including a bottom facing away from said stringer tape, said teeth being provided on said bottom.

4. A separable slide fastener according to claim 2, said body including a pair of opposite surfaces one on each side of said stringer tape, said teeth being provided on each of said surfaces.

5. A separable slide fastener according to claim 2, said body including a bottom facing away from said stringer tape and a pair of opposite surfaces one on each side of said stringer tape, said teeth being provided on each of said bottom and opposite surfaces. on said body and having an extent longitudinally

* * * * *